United States Patent [19]

Williams

[11] Patent Number: 4,489,510

[45] Date of Patent: Dec. 25, 1984

[54] FRICTION SOLED SHOE SLIPPER

[76] Inventor: Robert M. Williams, 1155 Sharie La., Green Bay, Wis. 54304

[21] Appl. No.: 414,943

[22] Filed: Sep. 3, 1982

[51] Int. Cl.[3] ..... A43B 13/14

[52] U.S. Cl. ..... 36/103; 36/113; 36/7.6; 36/31; 36/59 C

[58] Field of Search ..... 36/7.1 R, 7.6, 7.7, 36/8.3, 9 R, 43, 31, 59 C, 59 R, 25 R, 30 R, 87, 44, 113, 103

[56] References Cited

U.S. PATENT DOCUMENTS

| | | | |
|---|---|---|---|
| 992,221 | 5/1911 | Lowenback | 36/9 R |
| 1,210,521 | 1/1917 | Orr | 36/7.7 |
| 2,319,879 | 5/1943 | Pierson | 36/31 |
| 2,635,363 | 4/1953 | Dorgin | 36/43 |
| 2,924,029 | 2/1960 | Rosen | 36/7.1 R |
| 3,308,562 | 3/1967 | Zimmon | 36/9 R |
| 3,699,672 | 10/1972 | Sims | 36/7.7 |
| 4,217,704 | 8/1980 | Whitaker | 36/7.1 R |
| 4,356,643 | 11/1982 | Kester et al. | 36/59 C |

FOREIGN PATENT DOCUMENTS

| | | | |
|---|---|---|---|
| 522099 | 3/1921 | France | 36/59 |
| 1130380 | 7/1967 | United Kingdom | 36/44 |

*Primary Examiner*—Henry S. Jaudon
*Assistant Examiner*—Tracy G. Graveline
*Attorney, Agent, or Firm*—Andrus, Sceales, Starke & Sawall

[57] ABSTRACT

A shoe slipper cover has an inexpensive top plastic shell and a bottom friction pad structure which includes a plurality of relatively thin friction fibrous pads mounted in telescoped and overlapping relationship. A bottom plastic sole member is secured abutting the upper surface of the pads to define a protective inner sole. The edges of the shell and inner sole are sewn to each other and to the pads which project upwardly therebetween. The multiple pads in overlapping relationship form an essentially continuous sole structure with the overlapping portion creating ridges within the sole structure. The sole provides an appropriate support of the shoe on the wet floor while minimizing cost.

8 Claims, 6 Drawing Figures

FRICTION SOLED SHOE SLIPPER

BACKGROUND OF THE PRESENT INVENTION

The present invention relates to a friction soled shoe slipper and particularly to such a slipper adapted to be placed over the shoe of a workman for walking on wet slippery floors.

Floor maintenance personnel use various liquid substances for cleaning of floors. Many floors when wet become dangerously slippery. For example, in many industrial, institutional and other commercial applications, powered equipment is used with water and suitable cleaning chemicals for removing of wax, dirt and like foreign matter from the floor prior to coating with wax or other suitable material. The conventional workmen's shoe may readily be constructed to withstand the cleaning environment. Even limited protection against the liquid, particularly where strong chemicals are used, may however be desirable. Walking on the wet floor is extremely hazardous and workmen must take special care to prevent slipping and falling. In the normal course of events, falls often result with not infrequent severe physical damage. In addition to the physical harm to the personnel, there is of course the associated time loss and the like. Foot covers have been suggested to minimize the danger. For example, recent U.S. Pat. No. 4,217,704 which issued on Aug. 18, 1980 discloses a conventional oxford shoe rubber member with a thick pad secured to the bottom sole. The pad is formed of a fibrous material, such as widely employed as a friction cleaning pad in connection with powered floor cleaning equipment. A pad having a thickness of one half to one inch is suggested and secured to the bottom of the protective rubber and serves to support the workmen as they walk over the floor area. The friction characteristic is such that the danger of slipping is essentially eliminated.

The provision of an elastic rubber in combination with a thick continuous sole is a relatively expensive structure. Consequently although providing safety, as well as protection of the workmen shoe from the liquid and chemicals, the expense associated with the cover may be so high as to minimize commercial implementation. Other similar suggestions have been made. For example, U.S. Pat. No. 4,160,331 discloses a rubber member having a waffle-type bottom sole. The ridges of the sole are provided with a friction material, such as a combined adhesive and grit. Generally, the use of an adhesive grit, which presents a thin layer, would not provide a desired long life protective cover, such as can be provided by the addition of a pad member.

There is therefore a significant need for a long life reliable shoe cover adapted for use in slippery environments but of a relatively inexpensive and reliable construction.

SUMMARY OF THE PRESENT INVENTION

The present invention is particularly directed to a shoe slipper cover having a frictioned pad sole construction having an extended operating life particularly constructed in such a manner as to permit relatively inexpensive construction. Generally in accordance with the teaching of the present invention, the slipper cover includes an inexpensive top cover member formed of a thin flexible shell material, such as a suitable plastic. A bottom pad structure includes a plurality of relatively thin friction fibrous pads mounted in telescoped and overlapping relationship. A bottom protective sole member, preferably formed of a plastic or other suitable water impervious material, is secured abutting the upper surface of the telescoped pads to define a protective inner sole. The assembly is secured by sewing or otherwise interconnecting of the lower edge of the shell to the lower inner sole with the pad material projected upwardly therebetween. In a particularly practical construction, the pad members are formed of a thickness of approximately one quarter inch and project upwardly just between the shell and the inner sole a sufficient distance to provide a sewing lip. The total assembly is interconnected by simple sewing operation.

Generally in accordance with the teaching of the present invention, the sole structure includes a multiple pad assembly with the pads constructed in overlapping relationship to form an essentially continuous sole structure with the overlapping portion creating ridges within the sole structure. The overlapping pads, of course, are interconnected to each other and to a top protective shoe cover or shell for releasable connection attachment to the workmen's shoe. The relatively thin overlapped pad provides an appropriate support of the shoe on the wet floor while minimizing the expense of the slipper cover. In addition, the top shell can be formed of a simple and inexpensive material such that the total assembly can be designed as a simple inexpensive unit having a necessary operating life but permitting economic throwaway after a normal extended life, such as on the neighborhood of fifty hours or the like.

The present invention has been found to provide a relatively simple, inexpensive shoe cover for workmen who must work cleaning floors and the like under relatively slippery conditions.

BRIEF DESCRIPTION OF THE DRAWING FIGURES

The drawing furnished herewith illustrates a preferred construction of the present invention in which the above advantages and features are clearly disclosed as well as others which will be readily understood from the following description.

DESCRIPTION OF THE ILLUSTRATED EMBODIMENT

Figure 1:
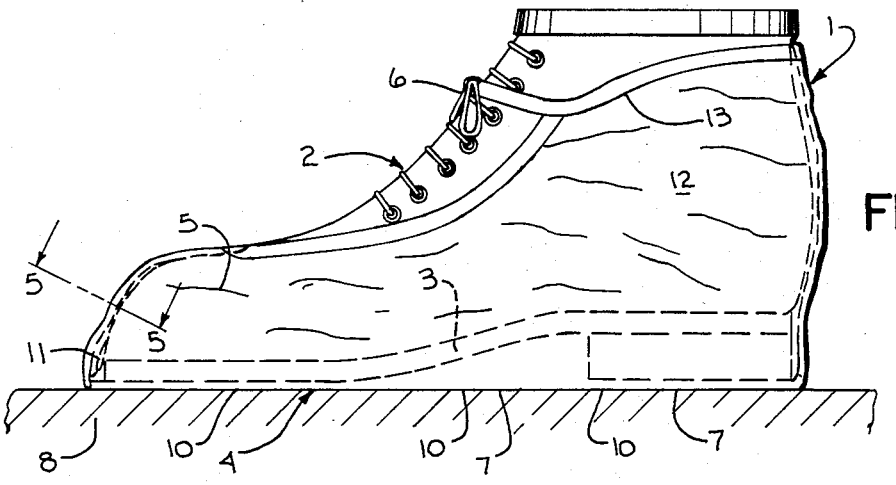
FIG. 1 is a side elevational view of a shoe or of a protective cover illustrating an embodiment of the invention and applied to a typical workmen's shoe.
Figure 6:
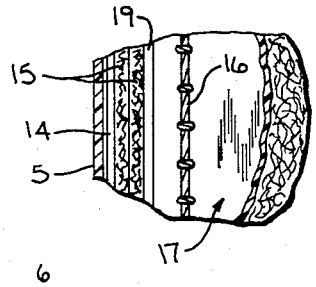
FIG. 6 is an enlarged sectional view taken generally on line 6—6 of FIG. 3.
Figure 5:
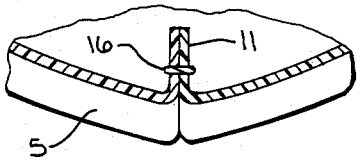
FIG. 5 is an enlarged edge sectional view taken generally on line 5—5 of FIG. 1.

Referring to the drawing and particularly to FIG. 1, a shoe slipper cover 1 is shown secured in protective overlying relationship to a workmen's shoe 2 of the conventional angle type. The shoe 2 is typical of those worn by workmen but may of course be of an oxford type, a boot type or any other suitable construction. The sole 3 of the shoe 2 is of any conventional construction, but in generally useable various adverse environments. Universally, however, the conventional shoe when used or worn in a wet environment, such as encountered in floor cleaning and the like, does not have any significant traction and the workmen with the conventional shoe 2 operates under hazardous walking and working conditions. The shoe cover 1, which illustrates an embodiment of the present invention, includes a unique multiple pad sole structure 4 and is preferably constructed so as to cover essentially the complete sole 3 of the shoe 2. The multiple pad sole structure 4 is secured to an upper shell 5 formed of a flexible plastic or the like. The shell 5 has an open top which is larger than the shoe 2 and through which the shoe is readily inserted. A suitable securement unit, such as a string-type tie 6, is provided on the shell 5 to releasably secure the cover 1 to the shoe 2. Any other suitable securement means, such as a "Velcro" attachment, an elastic band member, or the like may of course be used. The string tie means provides a simple and inexpensive means.

The multiple pad structure 4 creates a plurality of longitudinally spaced ridges 7 which permit the use of a relatively thin pad material, as well as providing a highly effective frictional engagement between the cover and the wet floor 8. The cover 2 provides an effective safety means for converting a conventional shoe into a safe walking shoe for use in or on slippery floors.

More particularly in the illustrated preferred embodiment of the present invention, the cover sole structure includes four pad members 10 of a generally similar longitudinal length. The pad members 10 are located in telescoping overlapping relationship, with each foreward pad telescoped over the leading end of the immediate rearward pad to form the ridge 7. Although the extent of the overlap is not critical, it is desirable to have significant overlap such that in use the pads do not move with respect to each other so as to locate them in a single common plane. The trailing edge of each pad 10 is thus below the leading edge of the trailing pad 10 and walking on the floor does not tend to cause surface liquid to move upwardly between the pads.

Figure 4:
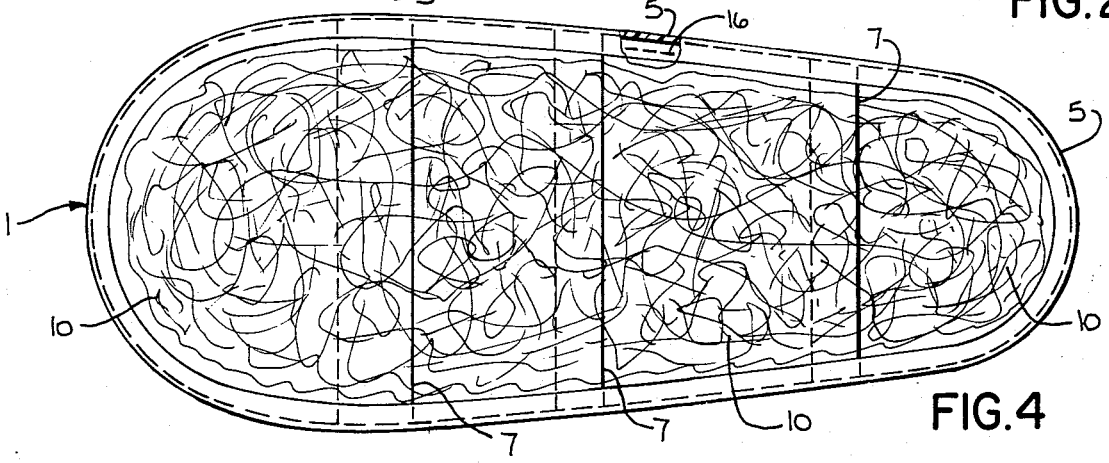
FIG. 4 is a bottom view of the shoe slipper cover shown in FIGS. 1-3.

The pads 10 are preferably shaped with the front, rear and side edges of the pad shaped to generally define the peripheral configuration of a shoe 2, as most clearly shown in FIG. 4. Because the present invention, particularly in its preferred construction, provides a reasonable loose slipper type cover, the configuration and size is not critical. The sole structure does not have to accurately conform to the dimensional size and configuration of the workmen's shoe sole 3 but some general correspondence is of course desired.

The top shell 5 is shown formed of a single sheet of plastic material. The single sheet may be conveniently formed as an elongated member which is symmetrical about the back heel portion, and then folded onto itself. The shell 5 is formed by sewing of the opposed outer end edges 11 which then defines the toe a continuous top toe cover portion. The shell 5 thus forms a continuous encirclement of the shoe upper generally in accordance with the side wall structure of an oxford shoe. The shell 5 projects upwardly to define side wall portions 12 extending upwardly about the ankle of the shoe, or of the workmen if wearing oxford type shoes.

In the illustrated embodiment of the invention, the shell 5 is formed of a flexible vinyl plastic which is readily die cut or otherwise shaped from a roll of the material. The upper edge of the plastic shell is covered with a cloth tape 13 to provide a finished comfortable edge. The cloth tape 13 is conveniently attached as by conventional sewing. The uppermost edge tape is also extended outwardly to define a pair of tie strings 6 extending outwardly from the uppermost edge of the top shell 5.

The bottom edge of the shell 5 is adapted to be folded upwardly into the shell to define an attachment lip 14 for interconnection to the multiple pad sole structure 4.

The sole structure 4 in turn projects upwardly along the lip 14 as at 15 and is firmly interconnected to the shell lip 14. The sole pads 10 and shell 5 are shown secured to each as by a conventional well known sewn connection 16. This provides a simple, inexpensive construction, which is however highly reliable and effective over the expected life of a slipper shoe cover.

The pads 10 are each formed of a similar material and thickness in the illustrated embodiment of the invention. Each pad 10 may be of an approximately one quarter thickness. The pads 10 overlap on the order of approximately one inch. The material is preferably a synthetic fibrous material used in floor maintenance. Such material has significant sharp edges which produce firm frictional engagement with the slippery floor and provide firm walking. A particularly satisfactorily material is the fibrous synthetic polyester floor cleaning material sold by Micro-Tron Abrasive of Pineville, N.C. As such material is well known, no further description or discussion is given herein. However, any other suitable long life and high friction material can be employed.

Figure 3:
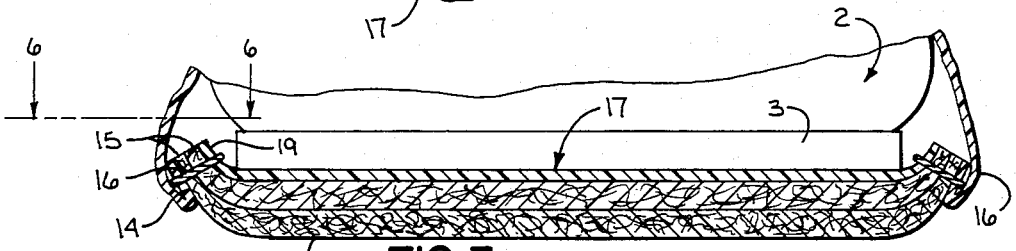
FIG. 3 is a transverse section taken generally on line 3—3 of FIG. 2.
Figure 2:
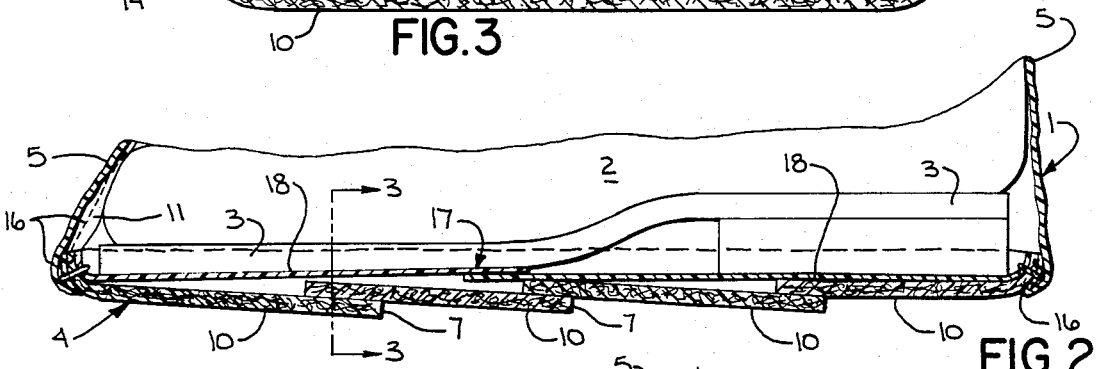
FIG. 2 is a fragmentary longitudinal vertical section through the slipper cover shown in FIG. 1.

Generally the fibrous type material is porous and liquid can reasonably readily pass therethrough. In addition the overlapping of the pads 10 defines an additional path through which the liquid can move. Such porosity may be desirable in permitting breathing of the shoe cover and thus minimizing uncomfort associated with a total enclosure fluid type enclosure of the workmen's foot. Thus, when the workmen are working in normal room temperature, more so when in an elevated temperature area, a rubber shoe covering tends to cause perspiration and some uncomfort because of the lack of breathing. However, it is not generally desirable to permit complete exposure of the shoe to the liquid. To this end an inner sole or bottom liner unit 17 is preferably provided. The illustrated liner unit 17, as shown in FIG 3, consists of a plurality of longitudinally spaced and overlapping plastic sheets 18, which is shown as a single pair of members. The inner sole liner unit 17 may conveniently be formed of the identical material used for the outer top, shell, such as a relatively low cost plastic. The inner sole liner unit 17 is secured overlying the inner face of the overlapping pads 10 and is secured in place by the common threaded connection 16 of the sole pads 10 to the shell 5. The edge of the inner sole unit 17 thus extends upwardly over the peripheral edge of the pads 10 as at 19 in FIG. 3 with the thread extending simultaneously through the pads, the top shell and the inner sole liner on the opposite sides of the pads.

In use, the slipper cover 1 is opened and the workmen slip their shoe into the large top opening, with their toe moving into the toe area and their heels moving downwardly into the heel portion. The tie strings 6 are wrapped around the front of the shoe or ankle and tied to releasably secure shell 5 in place. The shell 5 is generally somewhat larger than the shoe 2 and can be readily attached to shoes of different sizes within any reasonable range. Thus, shoe covers can readily be sold in small, medium and large sizes to cover the total shoe ranges.

Once attached, the bottom multiple pad sole unit 4 provides a firm, high friction support on the floor 8. The ridged structure provides an effective support as well as permitting use of the sole to clean stubborn spots on the floor.

The present invention provides a low cost foot cover which can be manufactured and sold as a consumable throwaway high friction foot cover.

Various modes of carrying out the invention are contemplated as being within the scope of the following claims, particularly pointing out and distinctly claiming the subject matter which is regarded as the invention.

I claim:

1. A foot cover for releasable attachment to a foot for providing firm footing on a slippery surface, comprising a multiple pad sole including a plurality of pads secured in an overlapping relationship and defining a bottom sole adapted to substantially underlie the sole of a foot, a shell means adapted to be releasably secured over the foot, and means interconnecting of the pads and the shell to define an integrated structure for releasable attachment in a covering relationship over the foot with said multiple pad sole defining the supporting bottom sole.

2. The cover of claim 1 wherein each of said pads is an integrated continuous pad formed of a fibrous material of a substantial thickness, and each pad extends completely across the sole.

3. The cover of claim 2 wherein said shell includes a bottom attachment lip extending in a reverse fold into the shell, said pads abutting said lip, and means securing the pads to said lip.

4. The cover of claim 3 wherein said securement means is a sewn thread means.

5. The cover of claim 1 wherein the shell is formed of a flexible, non-elastic sheet material.

6. The cover of claim 1 having an inner sole secured to the top surface of the multiple pad sole and with the multiple pad sole extending between the shell means and the inner sole.

7. A nonslip shoe covering for attachment over a shoe and establishing firm footing on a wet slippery floor, comprising a top shell formed of a nonelastic, flexible sheet material, said sheet material being impervious to water, said shell being in the form of an upper shoe member including a toe and heel portion connected by side portions, the lower edge of the shell being turned inwardly and upwardly, a nonslip sole unit formed of a fibrous material and having a thickness substantially greater than the thickness of said shell and having the edge of the sole unit turned upwardly with the lower edge of said shell, an inner sole liner of a non-elastic flexible material overlying the inner face of the sole unit and having the edge of the liner turned upwardly with the sole unit, means interconnecting of the sole unit and liner with the upwardly turned edge to secure the shell and the sole unit to the inner sole liner, wherein said sole consists of four pad members of a substantially equal longitudinal length, said pad members being telescoped in overlapped longitudinal relation in excess of one-half inch.

8. The shoe cover of claim 7 where each of said pad members is formed with an unstressed thickness equally essentially to one quarter inch.

* * * * *